United States Patent [19]

Absler et al.

[11] 4,213,639

[45] Jul. 22, 1980

[54] CONTINUOUS BUSINESS FORM ASSEMBLY

[75] Inventors: Howard Absler, Skokie; Joseph Juszak; Thomas Gore, both of Crystal Lake, all of Ill.

[73] Assignee: Uarco Incorporated, Barrington, Ill.

[21] Appl. No.: 941,006

[22] Filed: Sep. 11, 1978

[51] Int. Cl.[2] ..... B41L 1/26

[52] U.S. Cl. ..... 282/11.5 A; 282/11.5 R

[58] Field of Search ..... 282/11.5 R, 11.5 A

[56] References Cited

U.S. PATENT DOCUMENTS

| | | | |
|---|---|---|---|
| 3,339,827 | 9/1967 | Steidinger | 282/11.5 A |
| 4,109,936 | 8/1978 | Steidinger | 282/11.5 A |

FOREIGN PATENT DOCUMENTS

| | | | |
|---|---|---|---|
| 1255118 | 11/1967 | Fed. Rep. of Germany | 282/11.5 R |
| 856196 | 6/1940 | France | 282/11.5 R |

*Primary Examiner*—Paul A. Bell

*Attorney, Agent, or Firm*—Wegner, Stellman, McCord, Wiles & Wood

[57] ABSTRACT

A continuous business form assembly including a plurality of elongated, superimposed plies of paper each having a face and a back, the face of each ply being uppermost. Transverse lines of weakening extend across the plies at regular intervals to enable the assembly to be separated into individual form lengths and the uppermost ply in the assembly is wider than the remainder of the plies and has a pin feed structure along at least one marginal edge displaced from the corresponding marginal edge of the remainder of the plies. Glued stubs in each form length of the assembly hold the plies in assembled relation and there is indicia on the faces of at least some of the plies for receiving variable information at a designated location. Image forming transfer material such as carbon is disposed at the interface of at least some of the plies for transferring variable information received on the face of the uppermost ply to at least some of the underlying plies. The invention minimizes the number of plies required in the assembly by utilizng the upper ply as a combination carier ply and "beater copy".

1 Claim, 3 Drawing Figures

CONTINUOUS BUSINESS FORM ASSEMBLY

BACKGROUND OF THE INVENTION

This invention relates to continuous business form assemblies, and more specifically, to such assemblies when used, for example, as tickets and which are fed through mechanical printers.

Increased automation has resulted in a drastic upsurge in the use of continuous business form assemblies which may be fed, in continuous form, through imprinting devices such as mechanical printers and then severed into individual form lengths thereby rendering it unnecessary to feed individual form lengths manually into a printer. In many cases, the assemblies are quite thick, i.e. composed of many sheets or plies of paper. A typical example is an airline ticket or the like which frequently may have a thickness of 10 to 12 sheets or plies.

Transfer material as, for example, spot carbon or microcapsule image formers are disposed at the interfaces of the various plies for transferring variable information received on the ply actually contacted by the printer to the underlying sheets or plies.

Because of the thickness of the assembly, the mechanical printer must impact upon the assembly with considerable force in order to assure that the images formed on the sheets or plies most remote from the one being struck by the printer are legible. As a consequence of the force required, more often than not the sheet or ply actually contacted by the mechanical printer is wholly or partially unusable and must be discarded. This sheet or ply is conventionally known as the so-called "beater copy".

Many such forms utilized today are not actually fully continuous in nature. They are continuous in the sense that they employ carrier strips, however. Such a form will conventionally have a continuous carrier strip provided with a control punch margin for feeding purposes as the lowermost element of the assembly. Individual form lengths, conventionally known as "unit sets" are adhered to the carrier strip along its length and transverse lines of weakening extend across the carrier strip in between each unit set. Imprinting by a mechanical printer occurs on the uppermost sheet of the unit set. Typically, because of the necessity of providing control punch margins, the carrier strip will be wider than the sheets forming each unit set and as a result of this, once a unit set has received the desired variable information and is separated from the assembly, the section of the carrier strip to which it is adhered is removed from the underside of the unit set and discarded. At the same time, the uppermost sheet or beater copy of the unit set is discarded for the reason that it is virtually unusable as mentioned above. Thus, if the ticket or form is to have a thickness of, say, 10 sheets, it is necessary that the form originate with a thickness of 12 sheets, the eleventh being the carrier strip and the twelfth being the beater copy.

Of course, in order to make such a form, it is necessary to have manufacturing equipment of the type that can locate a unit set at a desired position on a carrier strip and secure the same thereto, usually by gluing. Conceivably, an alternate method of forming such a form without such equipment would be to form all desired sheets of elongated plies which are assembled together on a collator, a piece of equipment much more typically found in the manufacturing facility of a continuous business forms manufacturer than the type of machine required to place unit sets on a carrier strip. To the applicant's knowledge, this procedure has not heretofore been followed. Specifically, because of the thickness of the assembly, even the transverse lines of weakening extending through the plies by which the assembly may be separated into individual form lengths, are not so weak as to allow easy separation due to the number of plies involved. Consequently, it has not been considered that wholly continuous assemblies would be suitable for use with imprinters of the type typically employed, for example when providing variable information on airline tickets, since the means by which such printers sever individual form lengths from the assembly after imprinting are not sufficiently positive to insure complete severing.

SUMMARY OF THE INVENTION

A principal object of the invention is to provide a new and improved continuous business forms assembly wherein the number of sheets or plies required to attain a given function can be reduced from that presently used to eliminate the expense thereof.

A second principal object of the invention is to provide a new and improved continuous business forms assembly which may be manufactured out of plural superimposed plies and which yet may be easily and positively severed into individual form lengths so as to enable the manufacture of such forms on conventional collating equipment.

The first of the above objects is achieved in a continuous business forms assembly including a plurality of form sets of superimposed sheets of paper, each sheet having a face and a back with the face of each sheet being uppermost. An elongated ply of paper having a width somewhat greater than that of the sheets and a length substantially longer than the length of each form set is provided and has an uppermost face and a lowermost back. Means assemble the sheets in each form set to each other and each form set to the ply along the length of the latter to define an assembly with the ply being uppermost and with at least one marginal edge of the ply being displaced in the corresponding marginal edge of the form set. Feeding means are provided along the length of the ply by its greater width at the one marginal edge and indicia is provided on the faces of at least some of the sheets in each form set for receiving variable information at designated locations. Image forming transfer means are disposed at the interfaces of the ply and the sheets having the indicia for transferring the variable information mechanically applied to the face of the ply to at least some of the underlying sheets in each of the form sets. Means also are provided on the ply to define a line of weakening therein between each of the form sets whereby the assembly may be separated into individual form lengths.

In the construction described in the immediately preceeding paragraph, the ply concurrently serves as a carrier strip and as the "beater copy" enabling a single thickness of paper to provide the function heretofore requiring two thicknesses of paper.

The second of the above objects is achieved in a structure comprising a plurality of elongated superimposed plies of paper each having a face and a back with the face of each ply being uppermost. Means extend across the plies at regular intervals defining lines of weakening whereby the assembly may be separated into individual form lengths and one of the plies in the assembly is wider than the remainder of the plies and has feeding means along at least one marginal edge displaced from the corresponding marginal edge of the remainder of the plies. Means are provided in each form length of the assembly for holding the plies in assembled relation and the plies are provided with indicia and image forming transfer means as appropriate. Means are also provided whereby a substantial majority of the plies are completely severed at the cross lines of weakening. As a consequence, positive severing occurs at each line of weakening even though the assembly is manufactured in wholly continuous form.

Other objects and advantages will become apparent from the following specification taken in connection with the accompanying drawings.

DESCRIPTION OF THE PREFERRED EMBODIMENT

Figure 1:
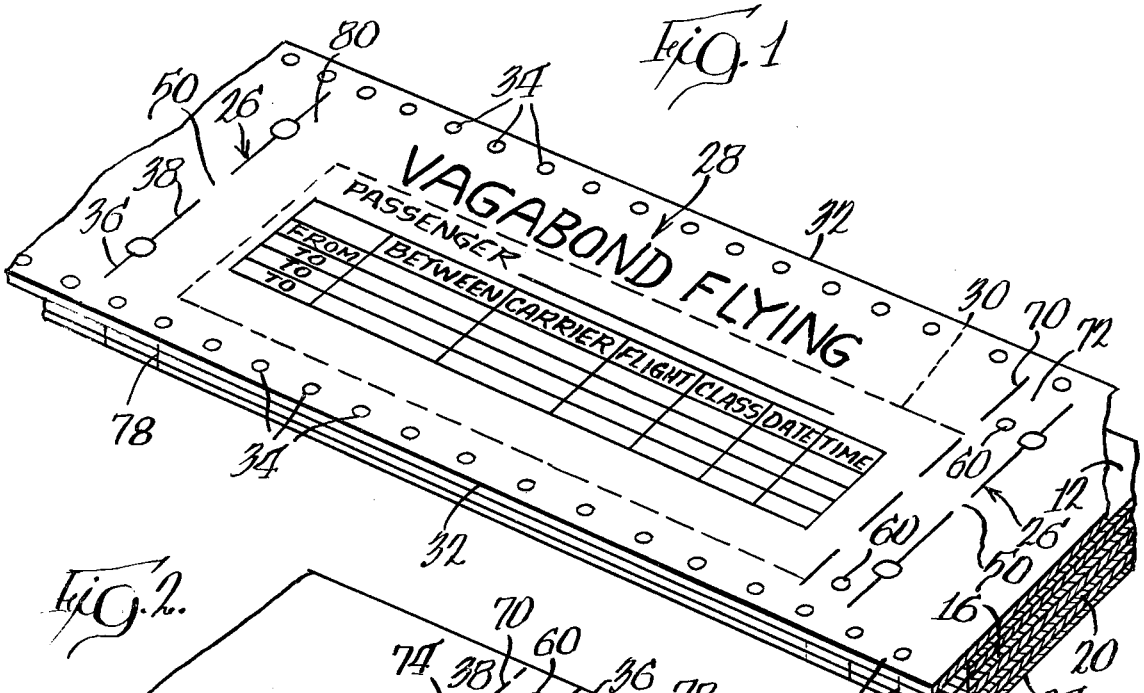
FIG. 1 is a fragmentary, perspective view of a continuous business form made according to the invention.

An exemplary embodiment of a continuous business form assembly made according to the invention is illustrated in FIG. 1 and is formed of a plurality of elongated, superimposed plies of paper. The uppermost ply is designated 10 while underlying plies are designated 12, 14, 16, 18, 20, 22 and 24 for a total of eight in all. However, it is to be understood that a greater or lesser number of plies could be used as desired. And, if the continuous business form assembly is not to be wholly continuous it will be understood that only the ply 10 need be made continuous while those designated 12–24 inclusive may be the individual sheets of a unit set adhered to the ply 10 in a conventional fashion. In such a case, the ply 10, which will be continuous and will have a length considerably longer than the length of each of the individual unit sets or packs adhered thereto.

Each of the plies 10–24 has an uppermost face and a lowermost back. Individual form lengths in the assembly are defined by transverse lines of weakening, generally designated 28, for receipt of variable information to be placed thereon by a mechanical printer. As seen in FIG. 1, such indicia 28 is also provided on the face of the ply 10 but this is not necessary for reasons that will appear.

At the interface of each ply 10–24 having the indicia 28 thereon, the back of the immediately uppermost ply is provided with image forming transfer means, normally in the form of spot carbon shown in outline form at 30. It is to be understood, however, that other forms of transfer means may be used as, for example, image forming chemical components contained in microcapsules which are ruptured upon mechanical imprinting on the ply 10.

The ply 10 has a width greater than the width of the plies 12–24 and at least one marginal edge of the ply 10 is displaced outwardly from the corresponding marginal edges of the plies 12–24. As seen in FIG. 1, two such displaced marginal edges 32 are provided and each includes a plurality of punched apertures 34 for receipt on pin feed tractors during manufacture of the form and/or tractors forming part of a printer. Alternately the marginal edges may be frictionally engaged and driven through a printer.

Figure 3:
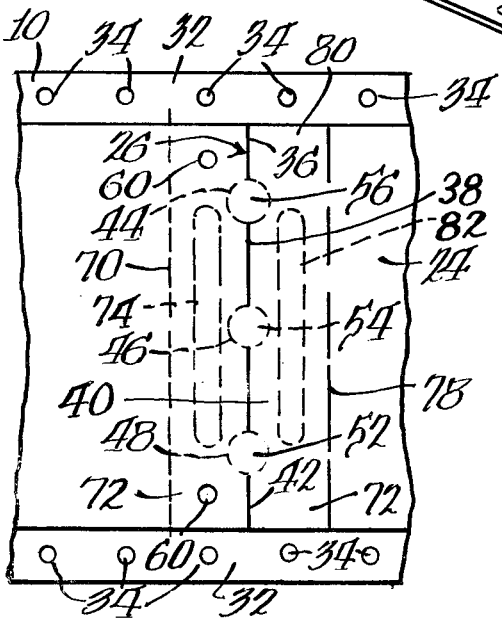
FIG. 3 is a fragmentary plan view of the junction between two adjacent form lengths in the continuous assembly.

In the exemplary embodiment, each line of weakening 26 is formed of slits 36, 38, 40 and 42 which extend throughout all of the plies 10–24. Each of the slits 36–42 are aligned and stop short of connection with each other. In addition, the slits 36 and 42 may extend partly into the displaced margins 32 of the ply 10 but not to the edge thereof so that the ply 10 remains continuous as seen in any of the figures. Punched apertures 44, 46 and 48 interconnect the adjacent ends of the slits as best seen in FIG. 3. The apertures 44 and 48 are disposed in each of the plies 10–22 omitting the ply 24 as best seen in FIG. 3 while the aperture 46 is located in the ply 12–22 omitting the plies 10 and 24. As a consequence, in addition to the continuity in the displaced margins 32, the ply 10 will be continuous at a location 50 aligned with the aperture 46, continuity being preserved by the absence of the aperture 46 in the ply 10.

Figure 2:
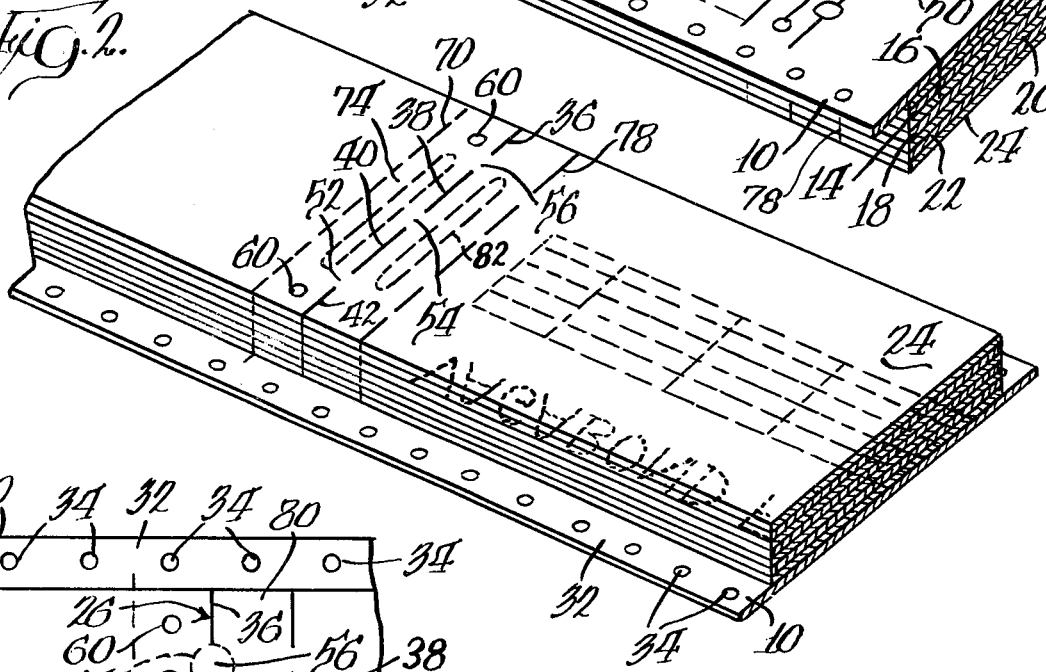
FIG. 2 is a similar perspective view but with the form inverted.

As best seen in FIGS. 2 and 3, the ply 24 will remain continuous at three locations 52, 54 and 56 each such location being aligned with one of the apertures 44–48. As a consequence of this construction, each of the plies 12–22 would be completely severed at the lines of weakening 26 so as to allow each severability of the assembly into individual form lengths.

The number of apertures omitted may vary dependant on the desired strength of the line of weakening.

It is desirable that continuous portions such as the continuous portion 50 and displaced margins 32 in the ply 10 and the continuous portions 52–56 in the ply 24 be maintained on the top and bottommost ply of the assembly so as to prevent completely loose edges from interfering with proper feeding.

In general, it is desired that a substantial majority of the plies, for example, 60 or 70 percent of them be completely severed at each line of weakening 26. Where somewhat greater strength at each line of weakening 26 is desired over that provided by the exemplary embodiment previously described, one or more of the apertures 44, 46 and 48 in one or more of the intermediate plies 12–22 can be omitted to provide continuous portions in the intermediate plies. However, in order to insure positive severing, it is preferred that a substantial majority of the intermediate plies be completely severed as mentioned previously.

Each form length of the assembly, adjacent one end thereof, is provided with two punched holes 60 extending through all plies 10–24 so that the same may be aligned to achieve registration of the indicia 28 on each ply as the ply is being assembled in a conventional collator. The holes 60 are required since only the ply 10 is provided with the feeding means 34 which would normally be used to attain such registration.

At the right-hand end of each form length with respect to the indicia 28, there is provided a second line of weakening 70 in all plies 10–24 to define a stub 72. Glue lines 74 at the interfaces of each of the plies 10–24 and in the stub 72 secure the plies together. The lines of weakening 70 have greater strength than the lines of weakening 26 so that the individual form lengths will separate at the latter and not at the former.

The left-hand end of each form length with respect to the indicia 28, a further line of weakening 78 is provided. As seen in FIG. 1, the line of weakening 78 is not located in the ply 10 and as seen in FIGS. 2 and 3, is generally provided in each of the plies 12–24 inclusive.

The line of weakening 78 defines a further stub 80 and glue lines 82 at the interface of the various plies in the stub 80 secure the same together.

To manufacture the form, the various plies have printing or indicia 28 applied on their backs, also as required. The various holes and lines of weakening as well as the glue lines 72 and 82, but not the slits 36–42 are all applied using conventional manufacturing techniques either just prior to or during assembly of the form on the collator at which time the ply 10 is run face down as the lowermost ply through the collator with the remaining plies being added thereto.

After all plies have been assembled, slits 36–42 are made to provide the desired severing as mentioned previously and completely define the line of weakening 26.

The form may then be zig-zag folded in the usual fashion and shipped to the ultimate user.

In use, the form is introduced into the mechanical printer by which variable information is to be placed on the assembly such that the face of the ply 10 will be immediately adjacent to mechanical printing means. The form is suitably driven through the printer and imprinted upon in the usual fashion. In the usual case, the force with which imaging is applied to the assembly will render the ply 10 substantially unusable. That is, the ply 10 is the so-called "beater copy". It will also be observed that the ply 10 acts as the carrier strip for carrying the remaining plies or sheets through the printer.

After imprinting, the printer will sever the inscribed form length from the remainder of the assembly along one of the lines of weakening 26. The operator may then remove the stub 72 freeing all plies at their right-hand ends and simply by pulling on the ply 10, will cause the glue lines 82 connecting the ply 10 to the ply 12 to rupture so that the combination carrier strip and beater copy defined by the ply 10 may be discarded as desired. Because the ply 10 is discarded, it is not necessary to provide the indicia 28 thereon as alluded to previously.

As a result, there will be provided an individual form length with the stub 80 intact, the ply 10 removed and the remainder of the plies 12–24 connected to each other only at their left hand ends relative to the indicia 28 and free at all other sides, the stub 72 having been previously removed. The result is a conventionally appearing multiple sheet or ply ticket or business form.

It will be appreciated from the foregoing description, that the locating of the carrier ply 10 uppermost in the assembly (as illustrated) rather than lowermost as is conventional, and placing the indicia on the opposite sides of the sheets or plies from the sides conventionally printed upon results in a considerable savings. In particular, one sheet or ply such as the ply 10 serves as both the beater copy and the carrier ply whereas prior art constructions require two such sheets or plies. Thus, the cost of one ply or sheet is eliminated making for a more economical business form. In addition, the thickness of the overall assembly is reduced by one sheet or ply and in many instances, this provides better so-called "carbonization", that is, a crisper formation of images on the plies most remote from that actually contacted by the printer. A more legible imaging is thereby provided.

It will also be observed that the means of forming the lines of weakening 26 insure that they are sufficiently weak so as to provide positive separation of each form length of the assembly and yet have sufficient strength so as to enable continuous feeding with the connecting portions on the uppermost and lowermost plies preventing snagging as the assembly is fed through a printer. This in turn allows the assembly to be manufactured on more conventionally used equipment and without the need of special equipment for adhering unit sets to a carrier strip.

What is claimed is:

1. A continuous business forms assembly comprising:

a plurality of superimposed plies of paper each having a face and a back, the face of each ply being uppermost, there being an uppermost ply, a lowermost ply and a plurality of intermediate plies;

the uppermost ply in said assembly being wider than the remainder of said plies and having punched margins displaced from the corresponding margins of the remainder of said plies to provide feeding means for feeding the assembly thru a printing device;

a plurality of first lines of weakening extending across said plies at regular intervals to define a plurality of individual form lengths of said assembly, each said first line of weakening being defined by a plurality of aligned, but separate, slits extending across all of said plies and through the same between the margins of said remainder of said plies but not in the margins of said uppermost ply, and holes in the intermediate plies of said assembly interconnecting the ends of adjacent ones of said slits;

a plurality of second lines of weakening in all of said plies on one side of corresponding first lines of weakening and closely adjacent thereto to define first stubs on each form length at one end thereof;

means between each said first and second line of weakening for securing the plies in assembled relation;

a plurality of third lines of lines of weakening in said remainder of said plies on the sides of corresponding ones of said first lines of weakening opposite said second lines of weakening, said third lines of weakening being closely adjacent corresponding first lines of weakening to define second stubs on each form length at the end thereof opposite said first stubs, said second stubs being only in said remainder of said plies;

means between said first and third lines of weakening securing said remainder of said plies in assembled relation and to said uppermost ply;

additional feeding means extending thru the plies of said assembly in one of said first and second stubs;

indicia on the faces of at least some of said plies in each form length for receiving variable information at designated locations; and an image transfer medium at the interfaces of said plies for transfering variable information mechanically applied to the face of said uppermost ply to at least some of the underlying plies in each of said form lengths.

* * * * *